US007124923B2

(12) United States Patent
Panasik

(10) Patent No.: US 7,124,923 B2
(45) Date of Patent: Oct. 24, 2006

(54) COMBUSTION-POWERED TOOL FUEL HEATING SYSTEM

(75) Inventor: Cheryl L. Panasik, Elburn, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/992,331

(22) Filed: Nov. 18, 2004

(65) Prior Publication Data

US 2006/0102108 A1 May 18, 2006

(51) Int. Cl.
*B25C 1/12* (2006.01)

(52) U.S. Cl. ..... 227/10; 123/46 H

(58) Field of Classification Search ..... 123/41.31, 123/46 R, 46 H, 543–558; 429/12; 227/10
See application file for complete search history.

(56) References Cited

U.S. PATENT DOCUMENTS

| | | | | |
|---|---|---|---|---|
| 4,403,722 | A | 9/1983 | Nikolich | |
| 4,483,473 | A | 11/1984 | Wagdy | |
| 4,483,474 | A | 11/1984 | Nikolich | |
| 4,522,162 | A | 6/1985 | Nikolich | |
| RE32,452 | E | 7/1987 | Nikolich | |
| 4,913,331 | A | 4/1990 | Utsumi et al. | |
| 5,197,646 | A | 3/1993 | Nikolich | |
| 5,263,439 | A | 11/1993 | Doherty et al. | |
| 5,971,245 | A * | 10/1999 | Robinson | 227/10 |
| 6,102,270 | A | 8/2000 | Robinson | |
| 6,145,724 | A | 11/2000 | Shkolnikov et al. | |
| 6,722,550 | B1 | 4/2004 | Ricordi et al. | |
| 6,783,047 | B1 * | 8/2004 | Granacher | 227/10 |
| 2003/0201297 | A1 | 10/2003 | Granacher | |

FOREIGN PATENT DOCUMENTS

| | | |
|---|---|---|
| EP | 1 254 745 A | 11/2002 |
| FR | 2 854 339 A | 11/2004 |

* cited by examiner

*Primary Examiner*—Tony M. Argenbright
*Assistant Examiner*—Katrina Harris
(74) *Attorney, Agent, or Firm*—Lisa M. Soltis; Mark W. Croll; Laura R. Wanek

(57) ABSTRACT

A combustion-powered tool has an engine and a heating system, where the tool receives and preheats a fuel cell. The fuel cell has a receiving portion for a heat transfer element which is associated with the engine. The heat transfer element is configured for engaging the fuel cell to conduct heat from the engine to the fuel cell.

19 Claims, 2 Drawing Sheets

COMBUSTION-POWERED TOOL FUEL HEATING SYSTEM

BACKGROUND

The present invention relates generally to handheld power tools, and specifically to combustion-powered fastener-driving tools, also referred to as combustion tools.

Combustion-powered tools are known in the art, and one type of such tools, also known as BUILDEX® brand tools for use in driving fasteners into workpieces, is described in commonly assigned patents to Nikolich U.S. Pat. Re. No. 32,452, and U.S. Pat. Nos. 4,522,162; 4,483,473; 4,483,474; 4,403,722; 5,197,646; 5,263,439 and 6,145,724, all of which are incorporated by reference herein. Similar combustion-powered nail and staple driving tools are available commercially from ITW-Paslode of Vernon Hills, Ill. under the IMPULSE®, BUILDEX® and PASLODE® brands.

Such tools incorporate a tool housing enclosing a small internal combustion engine. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. The engine includes a reciprocating piston with an elongated, rigid driver blade disposed within a single cylinder body.

Upon the pulling of a trigger switch, which causes the spark to ignite a charge of gas in the combustion chamber of the engine, the combined piston and driver blade is forced downward to impact a positioned fastener and drive it into the workpiece. The piston then returns to its original, or pre-firing position, through differential gas pressures within the cylinder. Fasteners are fed magazine-style into the nosepiece, where they are held in a properly positioned orientation for receiving the impact of the driver blade.

Conventional combustion fastener driving tools employ two types of fuel delivery systems, mechanical fuel injection and electronic fuel injection. With mechanical fuel injection, the fuel cell is provided with a metering valve, either affixed to the fuel cell or to the tool. The fuel cell is inserted into a fuel cell chamber of the tool with the bottom of the fuel cell facing generally towards the workpiece when the tool is oriented operationally. Once a fuel cell door is closed, formations on the door and/or internal linkages cause the fuel metering valve to dispense a measured quantity of fuel to the tool's combustion chamber.

When electronic fuel injection is employed, the delivery of fuel is controlled by a central processing unit (CPU) typically incorporating a microprocessor. In such configurations, the fuel cell is inserted into the fuel cell chamber in the opposite orientation relative to the mechanical fuel injection configuration. As such, the fuel cell is inserted with the dispensing end toward the tool's nosepiece. Once inserted, the fuel cell stem is sealingly engaged or coupled to a fuel injector controlled by the CPU.

When a combustion tool is operated in cold weather, cold fuel is fed from the fuel cell into the engine. Partial or complete interruption of the fuel flow can occur when vapor is formed in the fuel-feeding system, causing vapor lock. Thus, combustion tools typically incorporate a heating system in order to preheat the fuel. Conventionally, the fuel cell is placed parallel to the engine to absorb the heat transferred from the engine. However, the fuel cell is often placed a distance away from the engine as a safety precaution to separate the flammable fuel from the engine. The fuel cell may also be separated from the engine by a cover, housing partitions or other housing components. Although the safety reasons for separating the fuel cell from the engine are sound, the configuration also prevents the amount of heat transferred from the engine to the fuel cell, and may not be effective for preventing vapor lock in cold weather conditions.

In other prior art heating systems, such as when the electronic fuel injection is employed, a fuel line used to transmit the fuel from the injector to the combustion chamber is run parallel to the engine to capture the radiant heat from the engine. However, like the other prior art tools, the fuel line is placed a distance from the engine and may be separated by an engine cover, similar to the above discussion of the fuel cell, which results in relatively poor heat transfer. Additionally, the fuel line also has a very small cross-section and only a relatively small portion of the fuel is preheated at one time.

Another problem with prior art fuel cells is that they are permitted to rotate in the tool. While the fuel cell is designed to retain the fuel unless drawn by the tool, rotation of the fuel cell may lead to an increased likelihood of fuel leaks.

Thus, there is a need for a combustion-powered fastener-driving tool and fuel cell which address the problem of sufficiently preheating the fuel.

Further, there is a need for a combustion-powered fastener-driving tool and fuel cell which address the problem of fuel cell rotation in the tool.

BRIEF SUMMARY

The above-listed needs are met or exceeded by a combustion-powered tool having an engine and a heating system, where the tool receives and preheats a fuel cell. The fuel cell has a receiving portion for receiving a heat transfer element that is associated with the engine. The heat transfer element is configured to engage the fuel cell.

More specifically, a combustion-powered tool having an engine and a heating system is disclosed. The tool is configured to receive and preheat a fuel cell having a receiving portion. A heat transfer element is associated with the engine and is configured to extend proximate to the fuel cell.

Additionally, a fuel cell configured for receiving a heat transfer element of a combustion-powered tool having an engine is disclosed. The fuel cell includes a receiving portion configured for receiving the heat transfer element of the tool.

DETAILED DESCRIPTION

Figure 1:
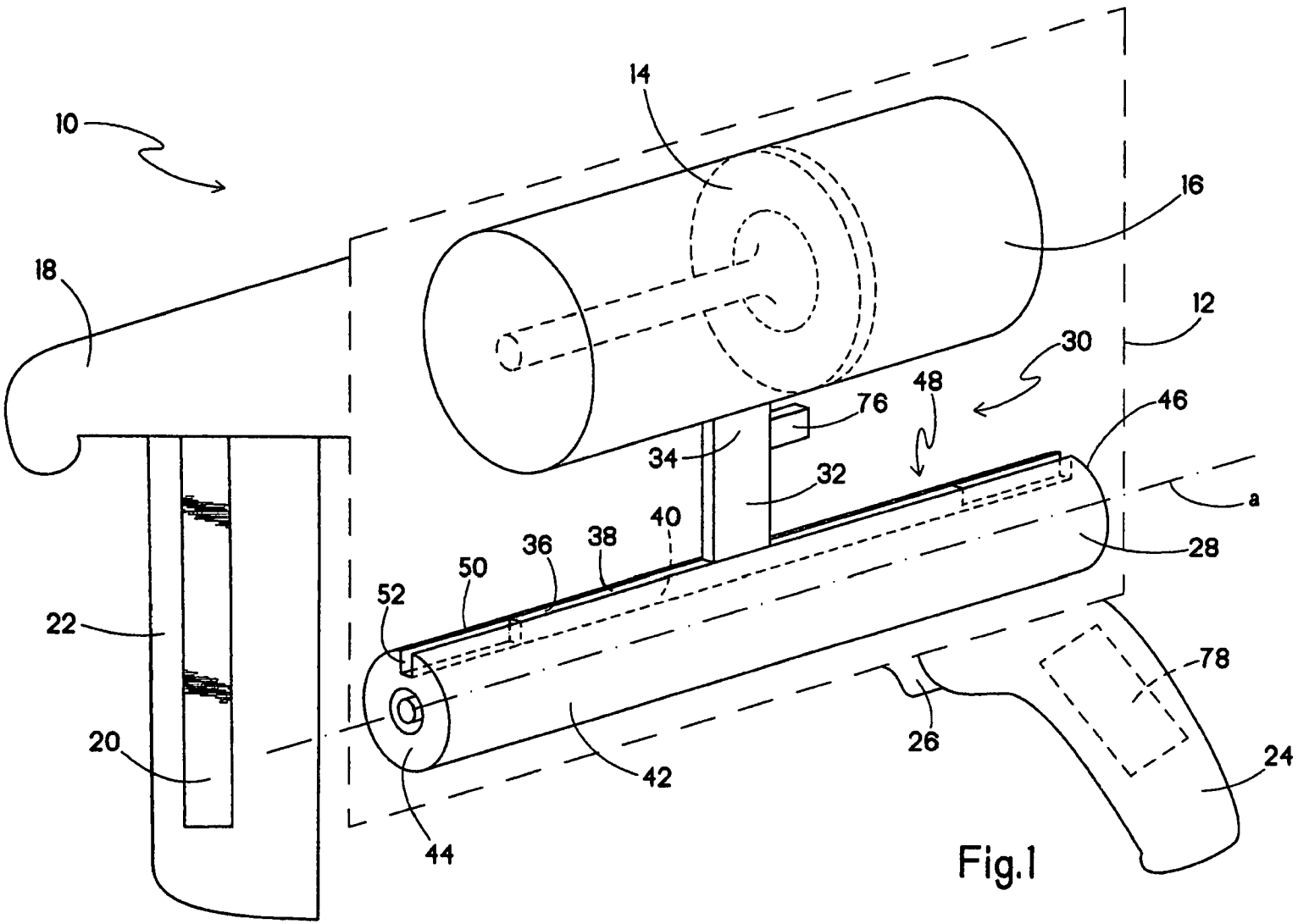
FIG. 1 is a schematic side perspective view of a combustion-powered fastener-driving tool with portions shown omitted for clarity and depicting a first embodiment of a heat transfer element engaged on a fuel cell in a first operational configuration.

Referring now to FIG. 1, a combustion-powered, fastener-driving tool suitable for incorporating the present heating system, is generally designated 10. While the tool 10 will be described in general terms as being of the type described in the patents listed above, other types of tools which use a fuel cell are contemplated as having the potential of incorporation of the present heating system. The tool 10 includes a main housing 12 (shown hidden), usually made of injection molded plastic or other suitable materials. In the present tool 10, a power source or engine 14 (preferably a combustion-powered power source as is known in the art and shown hidden) is enclosed by a power source or engine housing 16.

Other major components of the tool are the nosepiece assembly 18, which contacts the workpiece and through which fasteners 20 are driven, and a magazine 22 providing a supply of fasteners and configured for feeding the fasteners to the nosepiece assembly. A handle housing 24 is shown being secured to, or otherwise associated with the main housing 12 of the tool 10. As is well known in the art, the handle housing 24 is configured for accommodating a primary hand used to control the operation of the tool 10. The handle housing 24 incorporates a trigger switch 26 configured for initiating combustion and other tool functions as is well known in the art. The tool 10 also has a fuel cell chamber (not shown) that houses a fuel cell 28 to provide fuel to the engine 14.

The tool 10 includes a heating system 30 configured for preheating the fuel in the fuel cell 28. The heating system 30 includes a heat transfer element 32 having a tool-engaging portion 34 configured to engage the tool 10 and associated with the engine 14 or the engine housing 16, and a fuel cell engaging portion 36 configured to engage the fuel cell 28. Conducting heat from the combustion process in the engine 14, the heat transfer element 32 transfers heat to the fuel cell 28 to preheat the fuel and prevent undesirable vapor lock.

Since the fuel is volatile, it is preferred that the amount of heat transferred by the heat transfer element 32 be controlled. One way of controlling the amount of heat transferred is to select the material used for the heat transfer element 32 based on specific material properties, for example, thermal conductivity. In the preferred embodiment, the heat transfer element 32 is preferably aluminum, or any other material capable of transferring heat from the engine 14 to the fuel cell 28 at a rate that is small enough to prevent overheating the fuel, but large enough to preheat the fuel to prevent vapor lock during cold weather. Further, other materials can be used or added to the heat transfer element 32 to impede the heat transfer.

In the preferred embodiment, the heat transfer element 32 includes a fin 38 at the fuel cell engaging portion 36. The fin 38 is preferably generally elongate and preferably extends generally parallel to the fuel cell 28. Having at least one, but preferably two, contact surfaces 40 configured to contact the fuel cell 28, the fin 38 provides the surface area for heat conduction. As a general principal, the more surface area of the contact surface 40, the greater the capability for transferring the heat through conduction from the engine 14 to the fuel cell 28.

Although the heat transfer element 32 is depicted as having a general "T"-shape, it should be appreciated that any shape or configuration is contemplated which enables heat to be transferred from the tool-engaging portion 34 to the fuel cell engaging portion 36. Preferably, the heat transfer element 32 contacts and extends from the tool 10 at the engine housing 16 or the engine 14 a relatively short distance towards the fuel cell engaging portion 30. If the heat transfer element 32 is excessively long, the amount of heat conducted can be dissipated into the ambient, and the amount of heat transferred can be inadequate to prevent vapor lock. As a general principal, the more contact surface area 40 and the shorter the distance from the tool-engaging portion 34 to the fuel cell engaging portion 36, the greater the heat transfer capacity.

The fuel cell 28 has a generally cylindrical body 42 and includes a stem end 44 from which fuel is dispensed, as is known in the art, and a bottom end 46 opposite the stem end 44. The fuel cell 28 also includes a receiving portion 48. In the preferred embodiment, the corresponding receiving portion 48 on the fuel cell 28 is a slot 50 configured to receive the fin 38. Preferably, the slot 50 is shaped to mate flushly with the at least one contact surface 40 of the fin 38 at at least one receiving surface 52 to provide adequate surface area through which heat will conduct.

The slot 50 is preferably disposed on the generally cylindrical body 54 and preferably runs parallel to the longitudinal axis "a" of the fuel cell 28. Further, the slot 50 preferably extends generally radially from an outer fuel cell periphery toward the longitudinal axis "a" of the fuel cell 28. Generally, the further the slot 50 extends generally inward from the cylindrical body surface 54, the more surface area to conduct heat, and the more evenly heated the fuel cell contents.

While the preferred slot 50 is generally rectangular in cross-section, it is contemplated that the slot can be other shapes, such as arcuate, triangular or any other shape. Preferably, the shape of the slot 50 is configured to receive the fin 38. Further, while the slot 50 is depicted as running the entire length of the cylindrical body 42, shorter lengths are contemplated. In an alternate embodiment, the slot 50 can extend in a non-radial direction, can have different orientations, or can be disposed at the bottom end 46 of the fuel cell 28.

Figure 2:
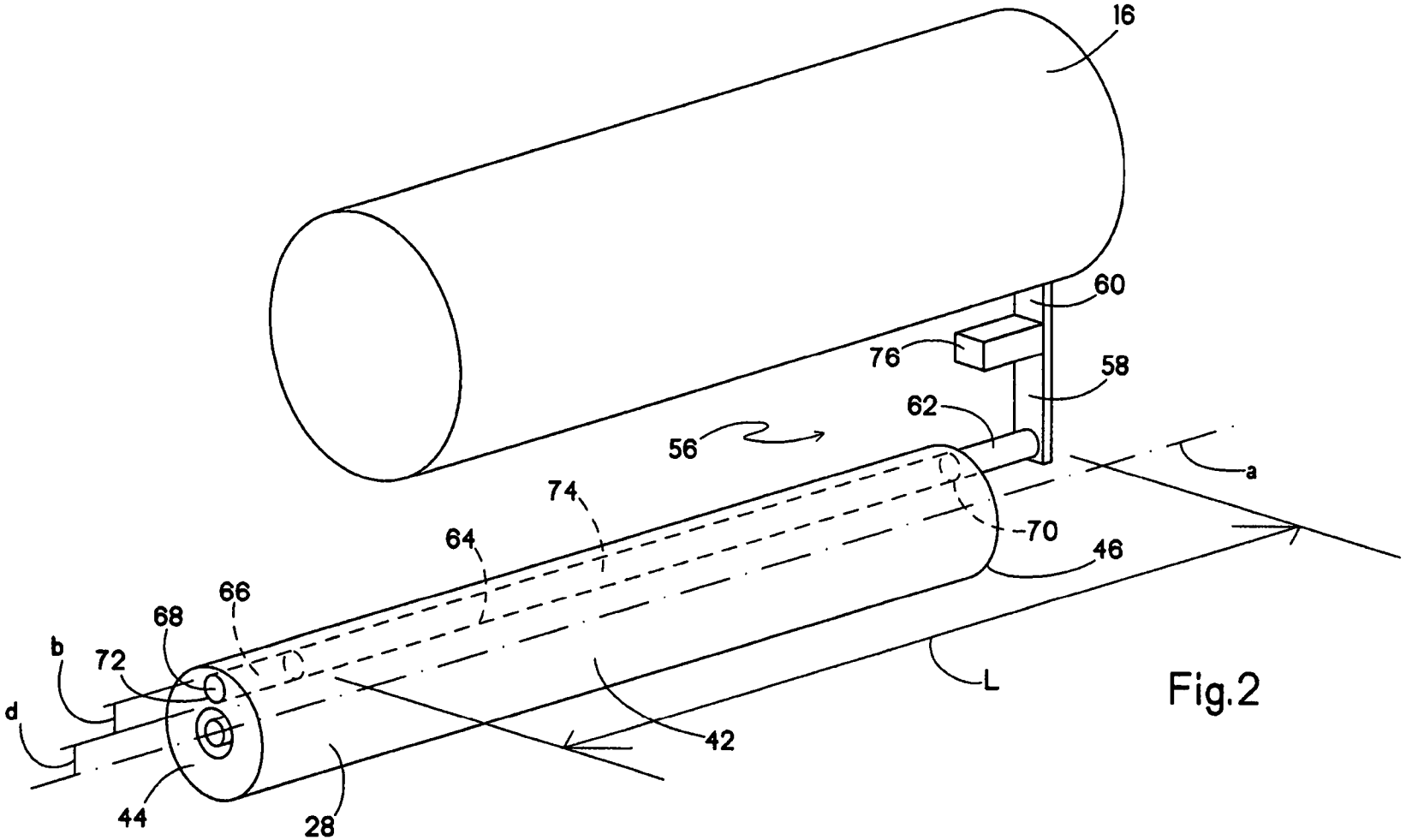
FIG. 2 is a schematic side prespective view of a second embodiment of a heat transfer element engaged on a fuel cell in a second operational configuration.

Referring to FIG. 2, a second embodiment of a heating system is depicted and is generally designated 56. Components of the system 56 which are identical to the system 30 are designated with identical reference numbers. The system 56 includes a heat transfer element 58 having a tool-engaging portion 60 and a fuel cell engaging portion 62. The fuel cell engaging portion 62 includes a probe 64 preferably configured to be received by the fuel cell 28. Similar to the fin 38 (FIG. 1), the probe 64 is disposed opposite the tool-engaging portion 60 and is configured to engage and transfer heat to the fuel cell 28. Further, the probe 64 also preferably includes a material that has good thermal conductive properties, such as aluminum.

In the preferred embodiment, the probe 64 is generally cylindrical, has a length "L", and is preferably configured to be inserted into a receiving portion 66 on the fuel cell 28. While the slot 50 could be suitable here, in this embodiment, the corresponding receiving portion 66 on the fuel cell 28 is a throughbore 68 or a counterbore (not shown) disposed on the fuel cell. The throughbore 68 is positioned to have a first aperture 70 on the bottom end 46, and to extend generally parallel to the longitudinal axis "a" through the fuel cell to a second aperture 72 on the stem end 44. Since the stem is generally disposed on or near the longitudinal axis "a", it is preferred that the throughbore 68 be proximate to, but radially displaced a distance "d" from the axis "a". However, the closer the throughbore to the axis "a", the more evenly the fuel will preheat in the fuel cell 28.

When the probe 64 extends into the throughbore 68, or alternatively, the counterbore, it is preferred that the probe include at least one contact surface 74 configured to contact the receiving portion 66. Preferably, the probe 64 is generally cylindrical having a diameter "b" slightly smaller than the diameter of the counterbore 68 to provide a continuous contact surface 74 around the probe. Generally, the more surface of the probe 64 that contacts the receiving portion 66, or the greater proportion of the probe length "L" within the receiving portion, the more heat transfer capability.

Although the probe 64 is depicted as generally cylindrical and configured to mate in a corresponding cylindrical receiving portion 66 parallel to the axis "a", it is contemplated that any shape and orientation of probe can be used to transfer heat to the fuel cell 28. Additionally, the shape and orientation of the receiving portion 66 can also be changed without departing from the invention in its broader aspects.

Referring to FIGS. 1 and 2, it is also contemplated that, rather than the the heat transfer element 32, 58 can merely be placed proximate to the fuel cell 28 to transfer heat through the ambient to the fuel cell. Further, it is contemplated the receiving portion 48, 66 can be contoured to be proximate to, but not contact the heat transfer element 32, 58.

In both preferred embodiments, when the heat transfer element 32, 58 is engaged on the fuel cell 28, the fuel cell is prevented from rotation. This, in turn, decreases the likelihood of fuel leakage that can occur when the fuel cell 28 is rotated. If the heat transfer element 32, 58 is broken, it could mean that the fuel cell 28 has been rotated and/or damaged. Further, if the heat transfer element 32, 58 is broken, it could mean that other portions of the tool are broken.

For these reasons, the tool 10 also includes a heat transfer element integrity sensor 76 constructed and arranged for sensing the integrity of the heat transfer element 32, 58. The sensor 76 is preferably disposed on or in operational proximity to the heat transfer element 32, 58. By emitting a resistance or eddy current along the element, by metering mechanical movement of the element, or any other electronic connecting types of sensing devices, the sensor monitors the condition of the element 32, 58. In the preferred embodiment, if the heat transfer element 32, 58 is damaged, such as by forced rotation of the fuel cell 28, the sensor 76 senses the change in current. If the heat transfer element 32, 58 is intact, the sensor 76 sends a signal to a control unit 78 (FIG. 1) such as a central processing unit in the tool 10 to indicate that firing of the tool can occur. If the heat transfer element 32, 58 is not intact, the sensor 76 sends a signal to the tool 10, such as to the control unit 78 or a separate electronic fuel injection microprocessor unit (not shown), to indicate that the engine spark should not occur, thus preventing firing of the tool.

While particular embodiments of the present combustion-powered tool having a heating system and a fuel cell have been described herein, it will be appreciated by those skilled in the art that changes and modifications may be made thereto without departing from the invention in its broader aspects and as set forth in the following claims.

The invention claimed is:

1. A combustion-powered tool having an engine and a heating system, the tool configured to receive and preheat a fuel cell having a receiving portion, comprising:

a heat transfer element associated with the engine and having an engaging portion configured for engaging the fuel cell at the receiving portion to conduct heat from the engine to the fuel cell, wherein the receiving portion is a formation in the fuel cell, and said engaging portion has a generally complementary shape to the formation.

2. The combustion-powered tool of claim 1, wherein said heat transfer element further comprises a tool-engaging portion configured for engaging and conducting heat from the tool.

3. The combustion-powered tool of claim 2, wherein said fuel cell engaging portion of said heat transfer element is a fin configured to be engaged with the fuel cell.

4. The combustion-powered tool of claim 3, wherein said fin has at least one surface configured for contacting the fuel cell in the receiving portion.

5. The combustion-powered tool of claim 2, wherein said fuel cell engaging portion of said heat transfer element comprises a probe configured to be engaged with the fuel cell.

6. The combustion-powered tool of claim 5, wherein said probe has at least one surface configured for contacting the receiving portion of the fuel cell.

7. The combustion-powered tool of claim 1, wherein said heat transfer element comprises a material capable of transferring heat from the engine to the fuel cell at a rate that is slow enough to prevent overheating the fuel, but fast enough to preheat the fuel to prevent vapor lock during cold weather.

8. The combustion-powered tool of claim 1, wherein said heat transfer element comprises aluminum.

9. The combustion-powered tool of claim 1 further comprising a heat transfer element integrity sensor configured for sensing the integrity of said heat transfer element.

10. The combustion-powered tool of claim 9, wherein said heat transfer element integrity sensor is configured and is connected to the tool for sending a signal to the tool indicating that the tool can be fired.

11. A fuel cell configured for receiving a heat transfer element of a combustion-powered tool having an engine, comprising:

a receiving portion configured for receiving the heat transfer element of the tool for receiving heat from the engine, wherein said receiving portion is a formation in one of a peripheral surface and an end surface of the fuel cell.

12. The fuel cell of claim 11, wherein said receiving portion is configured for contacting the heat transfer element of the tool.

13. The fuel cell of claim 11, wherein said receiving portion is located proximate to the heat transfer element of the tool.

14. The fuel cell of claim 11, wherein said receiving portion is a slot.

15. The fuel cell of claim 14, wherein said slot runs parallel to a longitudinal axis of the fuel cell.

16. The fuel cell of claim 14, wherein said slot extends radially toward a longitudinal axis of the fuel cell.

17. The fuel cell of claim 11, wherein said receiving portion is one of a counterbore and a throughbore.

18. The fuel cell of claim 17, wherein one of said counterbore and said throughbore is located proximate to and extends parallel to a longitudinal axis of the fuel cell.

19. The fuel cell of claim 11, wherein said receiving portion is configured for preventing rotation of the fuel cell when the heat transfer element is engaged with said receiving portion.

* * * * *